US009396680B2

(12) United States Patent
Lee et al.

(10) Patent No.: US 9,396,680 B2
(45) Date of Patent: Jul. 19, 2016

(54) DISPLAY DEVICE AND DRIVING METHOD THEREOF

(71) Applicant: SAMSUNG DISPLAY CO., LTD., Yongin, Gyeonggi-Do (KR)

(72) Inventors: Yul-Kyu Lee, Yongin (KR); Sun Park, Yongin (KR); Ji-Hoon Song, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 141 days.

(21) Appl. No.: 14/220,239

(22) Filed: Mar. 20, 2014

(65) Prior Publication Data

US 2014/0292625 A1 Oct. 2, 2014

(30) Foreign Application Priority Data

Mar. 26, 2013 (KR) ..... 10-2013-0032404

(51) Int. Cl.
*G09G 3/32* (2016.01)

(52) U.S. Cl.
CPC ..... *G09G 3/3233* (2013.01); *G09G 2300/043* (2013.01); *G09G 2300/0852* (2013.01); *G09G 2320/045* (2013.01); *G09G 2330/10* (2013.01)

(58) Field of Classification Search
CPC ..... G09G 2300/0842; G09G 2320/043; G09G 3/3233
USPC ..... 345/76–83, 92, 690–693
See application file for complete search history.

(56) References Cited

U.S. PATENT DOCUMENTS

2012/0154460 A1* 6/2012 Segawa ..... H01L 27/3276 345/690
2013/0120228 A1* 5/2013 Yoon ..... G09G 3/3291 345/80
2013/0127692 A1* 5/2013 Yoon ..... G09G 3/3258 345/80
2014/0118409 A1* 5/2014 Jun ..... G09G 5/02 345/690
2014/0340432 A1* 11/2014 Chaji ..... G09G 3/3233 345/690

FOREIGN PATENT DOCUMENTS

KR 10-2005-0109163 A 11/2005
KR 10-2008-0090954 A 10/2008
KR 10-2011-0013693 A 2/2011
KR 10-2013-0021029 A 3/2013

* cited by examiner

*Primary Examiner* — Kimnhung Nguyen
(74) *Attorney, Agent, or Firm* — Lee & Morse, P.C.

(57) ABSTRACT

A display device includes a normal pixel including a first driving transistor and a first compensation transistor connected to a gate and drain of the first driving transistor, and a compensation pixel including a second driving transistor and a second compensation transistor connected to a gate and drain of the second driving transistor. The second compensation transistor is open.

23 Claims, 6 Drawing Sheets

DISPLAY DEVICE AND DRIVING METHOD THEREOF

CROSS-REFERENCE TO RELATED APPLICATION

This application claims priority to and the benefit of Korean Patent Application No. 10-2013-0032404 filed in the Korean Intellectual Property Office on Mar. 26, 2013, the entire contents of which are incorporated herein by reference.

BACKGROUND

1. Field

Embodiments relate to a display device and a driving method thereof.

2. Description of the Related Art

A pixel circuit driving an OLED (Organic Light Emitting Diode) includes a driving transistor. To solve a problem caused by a threshold voltage difference among a plurality of driving transistors constituting a display device, the pixel circuit includes a compensation transistor.

The compensation transistor is diode-connected to the driving transistor and the threshold voltage of the diode-connected driving transistor is charged in a capacitor of the pixel circuit. Since a data voltage is stored along with the threshold voltage in the capacitor, OLED driving current (hereinafter, referred to as driving current) may not be affected by the threshold voltage of the corresponding driving transistor.

The above information disclosed in this Background section is only for enhancement of understanding of the background of the invention and therefore it may contain information that does not form the prior art that is already known in this country to a person of ordinary skill in the art.

SUMMARY

A display device according to an embodiment includes a normal pixel including a first driving transistor and a first compensation transistor connected to the gate and drain of the first driving transistor, and a compensation pixel including a second driving transistor and a second compensation transistor connected to the gate and drain of the second driving transistor. The second compensation transistor is opened.

A compensation control signal may be supplied to the gate of the first compensation transistor and the compensation control signal may not be supplied to the gate of the second compensation transistor.

The normal pixel may further include a first capacitor connected to the gate of the first driving transistor and the compensation pixel may further include a second capacitor connected to the gate of the second driving transistor.

The second capacitor may be short-circuited.

The normal pixel may further include a third capacitor connected between the gate and source of the first driving transistor and the compensation pixel may further include a fourth capacitor connected between the gate and source of the second driving transistor.

The compensation pixel may further include a second capacitor having one electrode connected to the gate of the second driving transistor and a fourth transistor connected to the other electrode of the second capacitor and the source of the second driving transistor.

The second capacitor may be short-circuited.

A normal power source voltage supplied to the first driving transistor may be different from a compensation power source voltage supplied to the source of the second driving transistor.

A high level of the compensation power source voltage may be determined in consideration of the threshold voltage of the second driving transistor.

The high level of the compensation power source voltage may correspond to a voltage obtained by subtracting the threshold voltage of the second driving transistor from a high level of the normal power source voltage.

A display device according to an embodiment includes a plurality of scan lines, a plurality of data lines, a compensation control line, a plurality of normal pixels connected to corresponding scan lines from among the plurality of scan lines, corresponding data lines from among the plurality of data lines and the compensation control line, and at least one compensation pixel connected to a corresponding scan line from among the plurality of scan lines and a corresponding data line from among the plurality of data lines, but not to the compensation control line. The display device may further include a first power line supplying a normal power source voltage to the plurality of normal pixels and a second power line supplying a compensation power source voltage to the at least one compensation pixel.

The first power line may be connected to the source of a first driving transistor of each of the plurality of normal pixels and the second power line may be connected to the source of a second driving transistor of the at least one compensation pixel.

When the display device includes two or more compensation pixels, a high level of the compensation power source voltage may be determined based on the threshold voltages of the second driving transistors of the compensation pixels.

The high level of the compensation power source voltage may correspond to a voltage obtained by subtracting a voltage determined based on the threshold voltages of the second driving transistors from a high level of the normal power source voltage.

The normal pixel may include a first driving transistor and a first compensation transistor having a gate connected between the gate and drain of the first driving transistor and connected to the compensation control line, and the at least one compensation pixel may include a second driving transistor and a second compensation transistor opened between the gate and drain of the second driving transistor.

The at least one compensation pixel may include a second capacitor having a first electrode connected to the gate of the second driving transistor, a switching transistor between a second electrode of the second capacitor and a corresponding data line, and having a gate connected to a corresponding scan line, and a third capacitor connected between the gate and source of the second driving transistor.

The second capacitor may be short-circuited.

A compensation power source voltage supplied to the source of the second driving transistor may be different from a normal power source voltage supplied to the source of the first driving transistor.

According to another embodiment, a method of driving a display device including a plurality of normal pixels and at least one compensation pixel includes: turning on a first compensation transistor connected to the gate and drain of a first driving transistor of each of the plurality of normal pixels during a predetermined period; transmitting data voltages respectively corresponding to the plurality of normal pixels and the at least one compensation pixel; and the plurality of normal pixels and the at least one compensation pixel emitting lights according to the data voltages corresponding thereto. A second compensation transistor connected to the gate and drain of a second driving transistor of the at least one compensation pixel is opened.

Transmitting the data voltages may include transmitting a corresponding data voltage through a first capacitor connected to the gate of the first driving transistor of each of the plurality of normal pixels; and transmitting a corresponding data voltage to the gate of the second driving transistor of the at least one compensation pixel.

Emitting light according to the data voltages may include supplying a normal power source voltage at a high level applied to the source of the first driving transistor; and supplying a compensation power source voltage at a high level applied to the source of the second driving transistor. The high level of the normal power source voltage may be different from the high level of the compensation power source voltage.

A difference between the high level of the normal power source voltage and the high level of the compensation power source level may be determined based on the threshold voltage of the second driving transistor.

DETAILED DESCRIPTION

Figure 1:
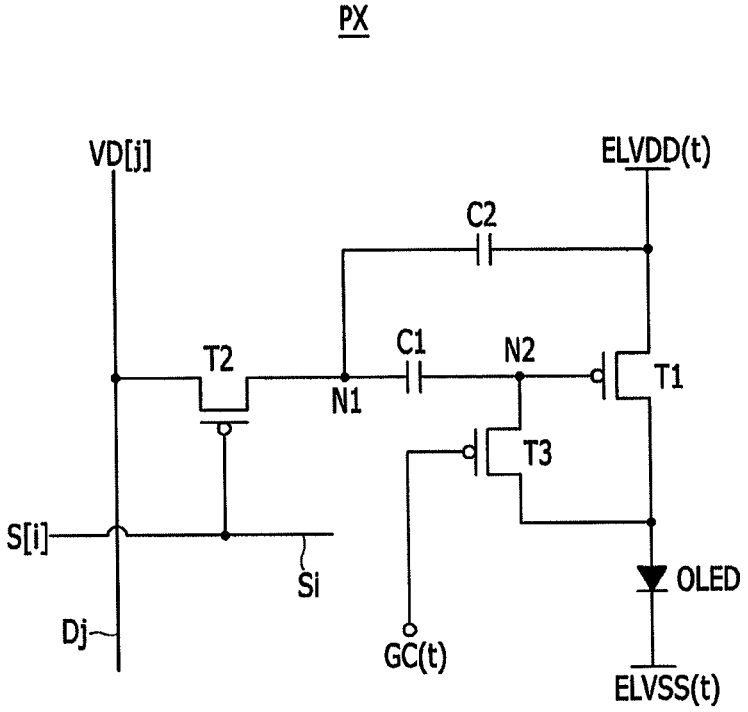
FIG. 1 illustrates a pixel of a display device according to an exemplary embodiment.

In the following detailed description, only certain exemplary embodiments have been shown and described, simply by way of illustration. As those skilled in the art would realize, the described embodiments may be modified in various different ways, all without departing from the spirit or scope of the disclosure. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

A pixel circuit, a display device including the pixel circuit and a method for driving the same according to an exemplary embodiment will now be described with reference to the attached drawings.

FIG. 1 illustrates a pixel of a display device according to an exemplary embodiment. Referring to FIG. 1, a pixel PX includes a driving transistor T1, a switching transistor T2, a compensation transistor T3, a capacitor C1, a capacitor C2, and an OLED.

The pixel PX is connected to a data line Dj and a scan line Si, a data voltage VD[j] is supplied to the pixel PX through the data line Dj and a scan signal S[i] is supplied to the pixel PX through the scan line Si.

A source of the driving transistor T1 is provided with a first power source voltage ELVDD(t), a gate thereof is connected to a first electrode of the capacitor C1, and a drain thereof is connected to the anode of the OLED.

A gate of the switching transistor T2 is connected to the scan line Si and the scan signal S[i] is applied thereto through the scan line Si. A first terminal of the switching transistor T2 is connected to the data line Dj and a second terminal of the switching transistor T2 is connected to a second electrode of the capacitor C1 and a first electrode of the capacitor C2.

When the switching transistor T2 is turned on by the scan signal S[i], the data voltage VD[j] is distributed to the capacitors C1 and C2 through the data line Dj and stored therein.

A gate of the compensation transistor T3 receives a compensation control signal GC(t), and a source and drain of the compensation transistor T3 are connected between the gate and drain of the driving transistor T1.

The cathode of the OLED is provided with a second power source voltage ELVSS(t)) and emits light according to driving current IDS flowing through the driving transistor T1.

Figure 2:
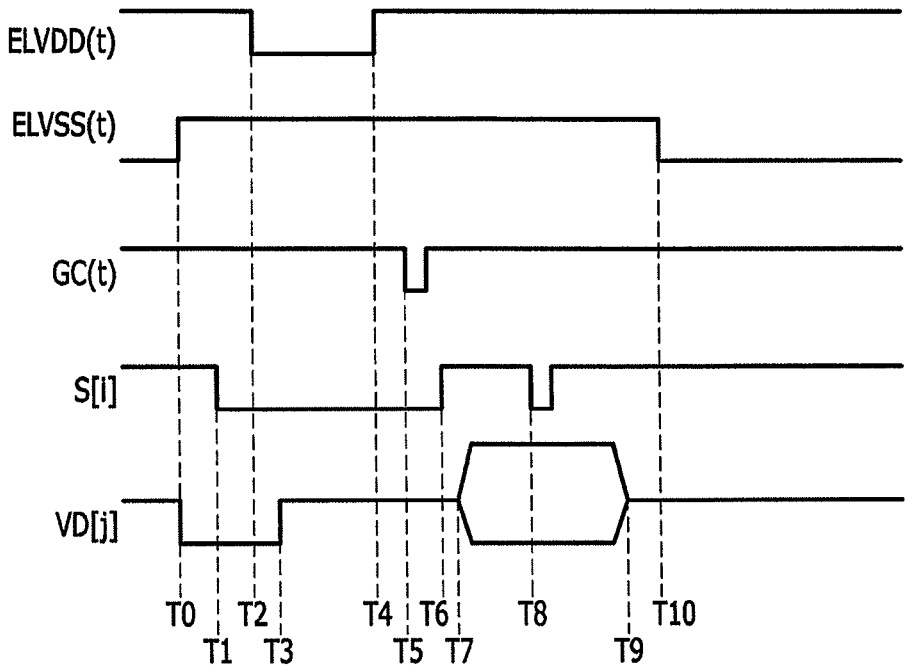
FIG. 2 illustrates a waveform diagram illustrating signals of the display device according to an exemplary embodiment.

The operation of the pixel will now be described with reference to signal waveforms of FIG. 2. FIG. 2 is a waveform diagram illustrating signals of the display device according to an exemplary embodiment.

Referring to FIG. 2, the second power source voltage ELVSS(t) rises to a high level and the data voltage VD[j] falls to a low level at a time T0. While FIG. 2 illustrates the data voltage VD[j] only, data voltages supplied to all data lines of the display device can fall to the low level at T0.

When the second power source voltage ELVSS(t) rises to the high level at time T0, driving current IDS does not flow through the OLED. For example, when the second power source voltage ELVSS(t) rises to the level of the first power source voltage ELVDD(t) at time T0, the driving current IDS does not flow because the source voltage and drain voltage of the driving transistor T1 become equal to each other.

The scan signal S[i] falls to the low level and the switching transistor T2 is turned on at a time T1. Since the switching transistor T2 and the compensation transistor T3 are P-type channel transistors, they are turned on by a low-level signal. Accordingly, the switching transistor T2 is turned on when the scan signal S[i] is at the low level and the compensation transistor T3 is turned on when the compensation control signal GC(t) is at the low level.

The capacitors C1 and C2 are connected to the data line Dj through the switching transistor T1 turned on at T1 at which the data voltage VD[j] is at the low level. Accordingly, the voltage of a node N1 to which the capacitors C1 and C2 are connected decreases to the low level and the voltage of a node N2 also decreases according to the voltage decrease at the node N1.

Upon decrease of the first power source voltage ELVDD(t) to the low level at a time T2, the driving transistor T1 is reversely biased when the voltage of the node N2 corresponds to the low level. Then, charges accumulated between the anode and cathode of the OLED are discharged.

The data voltage VD[j] rises to the high level at a time T3, the voltage of the node N1 rises through the turned on switching transistor T1 and the voltage of the node N2 also rises according to the voltage rise at the node N1. While FIG. 1 illustrates a rise of the data voltage VD[j] to the high level, data voltages supplied to all data lines of the display device may rise to the high level at time T3.

A reset operation of discharging charges accumulated in the OLED is performed in a period from the time T2 to a time T4 at which the first power source voltage ELVDD(t) rises to the high level.

The compensation control signal GC(t) falls to the low level and the compensation transistor T3 is turned on at a time T5. Accordingly, the gate and drain of the driving transistor T1 are connected (diode-connected) and thus the driving transistor T1 operates as a diode. The first power source voltage ELVDD(t) is applied to the source of the driving transistor T1 and a voltage ELVDD(t)+Vth corresponding to the sum of the first power source voltage ELVDD(t) and the threshold voltage Vth (Vth being a negative voltage) of the driving transistor T1 is applied to the gate and drain of the driving transistor T1, i.e., the node N2.

Accordingly, the threshold voltage of the driving transistor T1 is distributed to the capacitors C1 and C2 and stored therein. The distribution ratio depends on the capacitance ratio of the capacitor C1 to the capacitor C2.

The scan signal S[i] rises to the high level at a time T6. While FIG. 2 illustrates the scan signal S[i] only, scan signals supplied to all scan lines of the display device may rise to the high level at T6.

Plural scan signals may be sequentially supplied to plural scan lines of the display device in a scan period from a time T7 to a time T9. For example, as shown in FIG. 2, the scan signal S[j] of an i-th scan line falls to the low level at a time T8 and the switching transistor T2 is turned on. Thus, plural data voltages are supplied to plural data lines. While FIG. 2 illustrates only the data voltage VD[j] from among a plurality of data voltages, embodiments are not limited thereto, e.g., the plural data voltages may be supplied to all the data lines in synchronization with T8.

Upon termination of the scan period, the second power source voltage ELVSS(t) falls to the low level and the driving current IDS is supplied to the OLED. Consequently, the OLED emits light according to the driving current IDS.

When the compensation transistor T3 short-circuits in FIG. 1, the driving transistor T1 may be turned off. For example, the gate of the compensation transistor T3 and the electrode, e.g., the source, of the compensation transistor T3 connected to the gate of the driving transistor T1 may short-circuit.

Referring to FIG. 2, the compensation control signal GC(t) at the high level is supplied to the gate of the driving transistor T1 in an emission period after T10. Specifically, the high-level compensation control signal GC(t), supplied to the gate of the short-circuited compensation transistor T3, is applied to the gate of the driving transistor T1. Then, the driving transistor T1 is turned off.

Turn-off of the driving transistor T1 during the emission period may be recognized as a dark dot by a user of the display device. To prevent this, compensation transistors including the short-circuited compensation transistor should be open and/or the first capacitor should be short-circuited.

Figure 3:
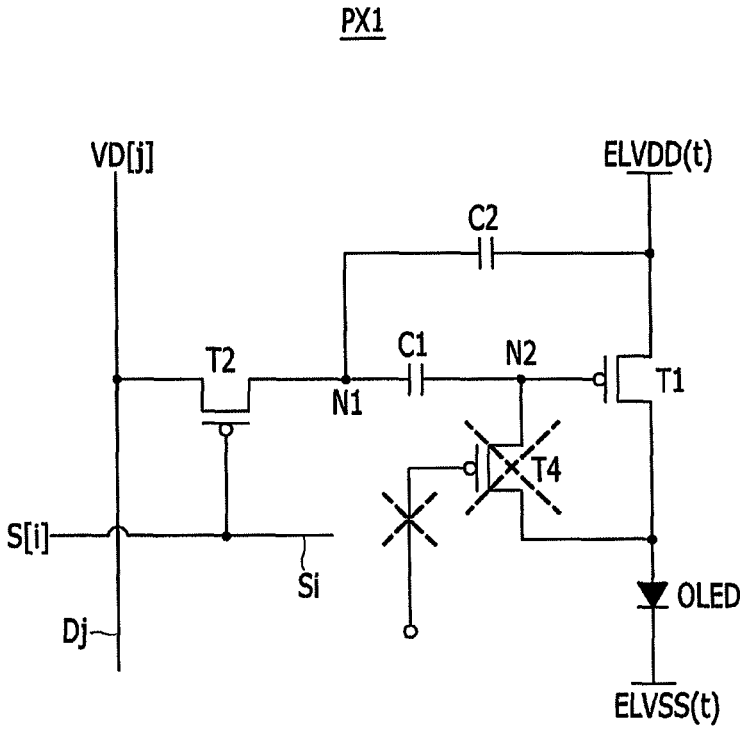
FIG. 3 illustrates a compensation circuit according to an exemplary embodiment.

FIG. 3 illustrates a compensation pixel PX1 according to an exemplary embodiment. Herein after, the pixel PX illustrated in FIG. 1 is referred to as a normal pixel.

The compensation pixel PX1 includes a pixel circuit modified to solve a non-emission problem caused by short circuit of the compensation transistor. For example, a compensation transistor T4 of the compensation pixel PX1 is laser-cut to be opened. In addition, the compensation control signal GC(t) is not applied to the compensation transistor T4. In FIG. 3, 'X' indicated by a dotted line represents an open state.

Since the compensation transistor T4 is open, the compensation control signal GC(t) is not applied thereto and a high-level voltage is not supplied to the gate of the driving transistor T1 during the emission period. Referring to FIG. 2, a voltage corresponding to the data voltage VD[j] supplied through the data line Dj is applied to the gate of the driving transistor T1 at T8 and sustained by the capacitors C1 and C2.

The driving transistor T1 generates the driving current IDS according to the gate voltage thereof after T10 and the OLED emits light according to the driving current IDS. Although the driving current IDS may be affected by the threshold voltage of the driving transistor T1, the compensation pixel PX1 is not recognized as a dark dot.

Figure 4:
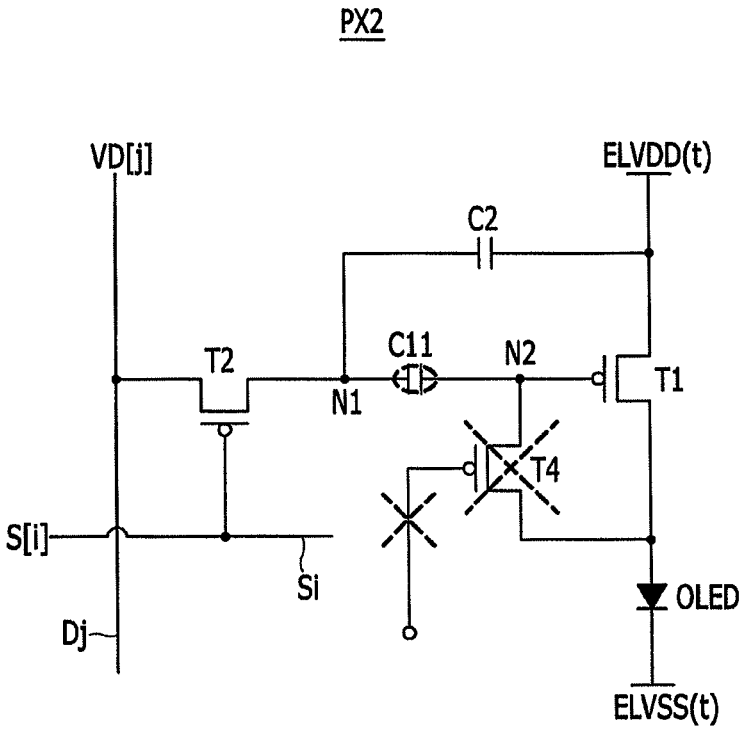
FIG. 4 illustrates a compensation circuit according to another exemplary embodiment.

FIG. 4 illustrates a compensation pixel PX2 according to another exemplary embodiment.

The compensation pixel PX2 includes a short-circuited first capacitor C11 and the opened compensation transistor T4. That is, the compensation transistor T4 is open and the first capacitor C11 of the compensation pixel P2 is short-circuited. Then, the data voltage can be directly applied to the gate of the driving transistor T1. Referring to FIG. 2, since the first capacitor C11 has been short-circuited, the data line Dj is connected to the gate of the driving transistor T1 at T8 at which the switching transistor T2 is turned on. Accordingly, the data voltage VD[j] is applied to the gate of the driving transistor T1. The driving transistor T1 generates the driving current IDS according to the gate voltage thereof after T10 and the OLED emits light according to the driving current IDS. Although the driving current IDS may be affected by the threshold voltage of the driving transistor T1, the compensation pixel PX1 is not recognized as a dark dot.

The threshold voltage of the driving transistor is not compensated according to the compensation pixels illustrated in FIGS. 3 and 4. To compensate the threshold voltage of the driving transistor, the first power source voltage supplied to the compensation pixel may be changed according to another exemplary embodiment.

For example, a voltage VSUS−Vth obtained by subtracting the threshold voltage Vth (negative voltage) of the driving transistor T1 included in the compensation pixel PX2 illustrated in FIG. 4 from a high level VSUS of the first power source voltage supplied to a normal pixel is supplied. The threshold voltage of the driving transistor T1 can be calculated using driving current flowing through the driving transistor T1, gate-source voltage of the driving transistor T1 and a predetermined coefficient.

Since the data voltage VD[j], VDATA, is applied to the gate of the driving transistor T1 at T8 in FIG. 2 and the first power source voltage ELVDD(t) is VSUS−Vth, the gate-source voltage of the driving transistor T1 is VDATA−VSUS+Vth. The gate-source voltage is sustained by the capacitor C2.

The driving current IDS is proportional to a voltage ((VDATA−VSUS+Vth)−Vth) obtained by subtracting the threshold voltage Vth of the driving transistor T1 from the gate-source voltage of the driving transistor T1 and squaring the resultant voltage. Thus, the driving current (IDS) is not affected by the threshold voltage Vth.

The method of changing the high level of the first power source voltage ELVDD(t) to compensate the threshold voltage of the driving transistor can be applied to the compensation pixel PX1 of FIG. 3. However, a voltage obtained by distributing the data voltage VD[j], VDATA1, according to the capacitance ratio of the capacitor C1 to the capacitor C2 is applied to the gate of the driving transistor T1. For example, the gate voltage of the driving transistor T1 may be VDATA1*(C2/(C1+C2)).

Since the data voltage VD[j], VDATA1, is applied to the gate of the driving transistor T1 and the first power source voltage ELVDD(t) is VSUS−Vth at T8 in FIG. 2, the gate-source voltage of the driving transistor T1 is VDATA1*(C2/(C1+C2))−VSUS+Vth. The gate-source voltage is sustained by the capacitors C1 and C2.

The driving current IDS is proportional to a voltage (VDATA1*(C2/(C1+C2))−VSUS+Vth )−Vth ) obtained by subtracting the threshold voltage Vth of the driving transistor T1 from the gate-source voltage of the driving transistor T1 and squaring the resultant voltage, and thus the driving current IDS is not affected by the threshold voltage Vth.

However, VDATA1 is generated as a voltage different from VDATA in consideration of distribution by the capacitors C1 and C2.

Figure 5:
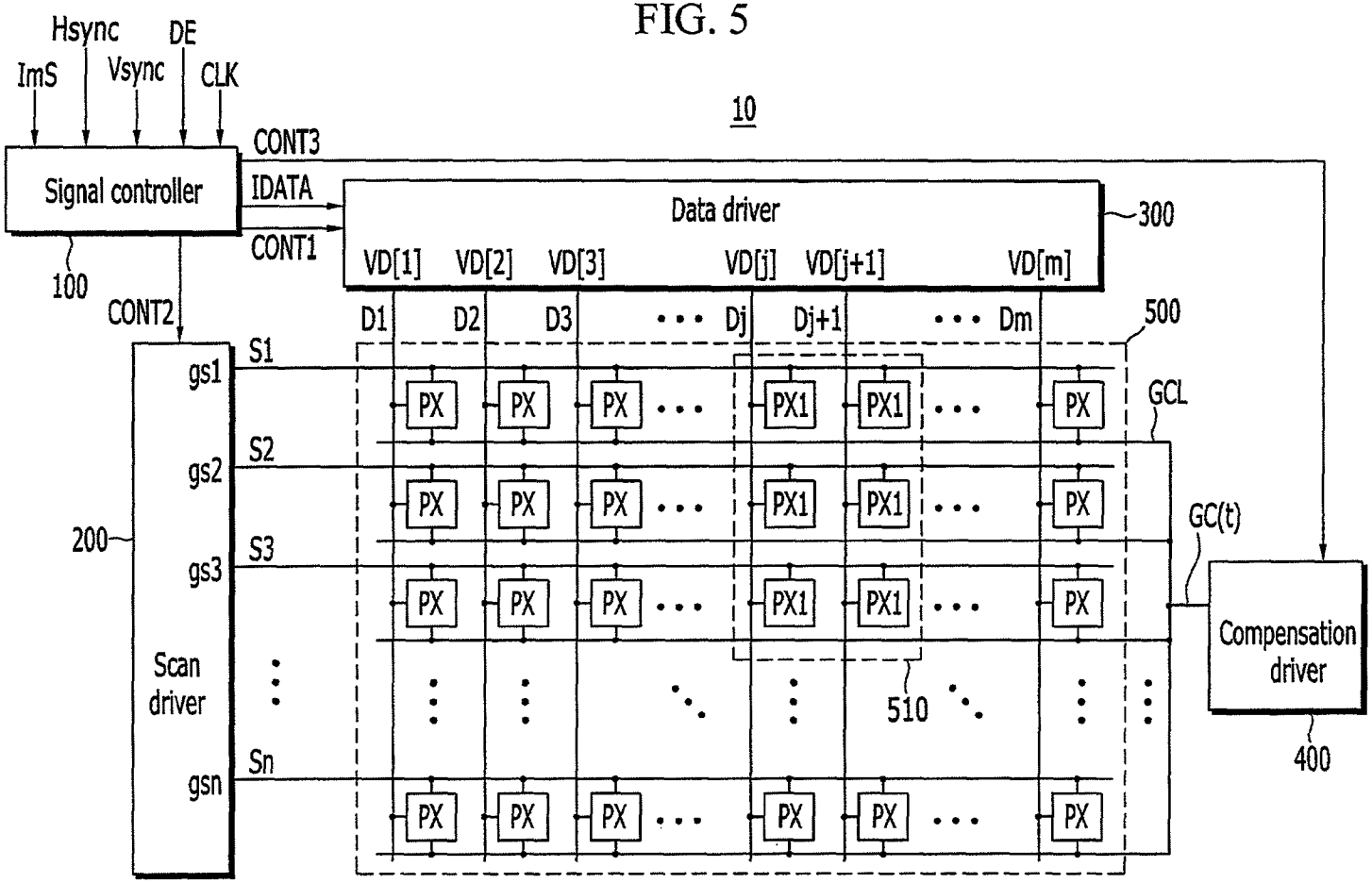
FIG. 5 illustrates a display device according to another exemplary embodiment.

A description will be given of a display device according to another exemplary embodiment. FIG. 5 illustrates a display device according to another exemplary embodiment.

A display device 10 illustrated in FIG. 5 includes a normal pixel PX and a compensation pixel PX1. While FIG. 5 illustrates the display device 10 including the compensation pixel PX1 and the normal pixel PX, embodiments are not limited thereto, e.g., the display device 10 may include the compensation pixel PX2 instead of the compensation pixel PX1.

The display device 10 includes a signal controller 100, a scan driver 200, a data driver 300, a compensation driver 400, and a display unit 500.

The signal controller 100 generates a first driving control signal CONT1, a second driving control signal CONT2, and a third driving control signal CONT3 for controlling an operation of displaying an image according to a vertical synchronization signal Vsync for dividing video frames, a horizontal synchronization signal Vsync for dividing lines of a frame, a data enable signal DE for controlling a period in which data voltages are applied to a plurality of data lines D1 to Dm, and a clock signal CLK for controlling a driving frequency. The signal controller 100 receives an image signal ImS, generates image data IDATA and transmits the image data IDATA, along with the first driving control signal CONT1, to the data driver 300.

The data driver 200 samples and holds the image data IDATA according to the first driving control signal CONT1 to convert the image data IDATA into a plurality of data voltages VD[1] to VD[m] and transmits the data voltages VD[1] to VD[m] to the plurality of data lines D1 to Dm.

The scan driver 300 generates scan signals gs1 to gsn corresponding to scan timings respectively corresponding to a plurality of scan lines S1 to Sn as low-level pulses according to the second driving control signal CONT2 and transmits the scan signals gs1 to gsn to the scan lines S1 to Sn.

The compensation driver 400 generates the compensation control signal GC(t) according to the third compensation control signal CONT3 and supplies the compensation control signal GC(t) to a compensation control line GCL.

The display unit 500 includes the plurality of scan line S1 to Sn, the plurality of data line D1 to Dm, the compensation control line GCL, a plurality of normal pixels PX, and a plurality of compensation pixels PX1.

The plurality of scan lines S1 to Sn is arranged in the horizontal direction and the plurality of data lines D1 to Dm is arranged in the vertical direction. The compensation control line GCL is connected to the plurality of normal pixels PX. As shown in FIG. 5, the plurality of compensation pixels PX1 is not connected to the compensation control line GCL.

In FIG. 5, a display area 510 in which plural compensation pixels PX1 are arranged is connected to corresponding data lines Dj and Dj+1 and corresponding scan lines S1, S2, and S3, and are not connected to the compensation control line GCL.

Figure 6:
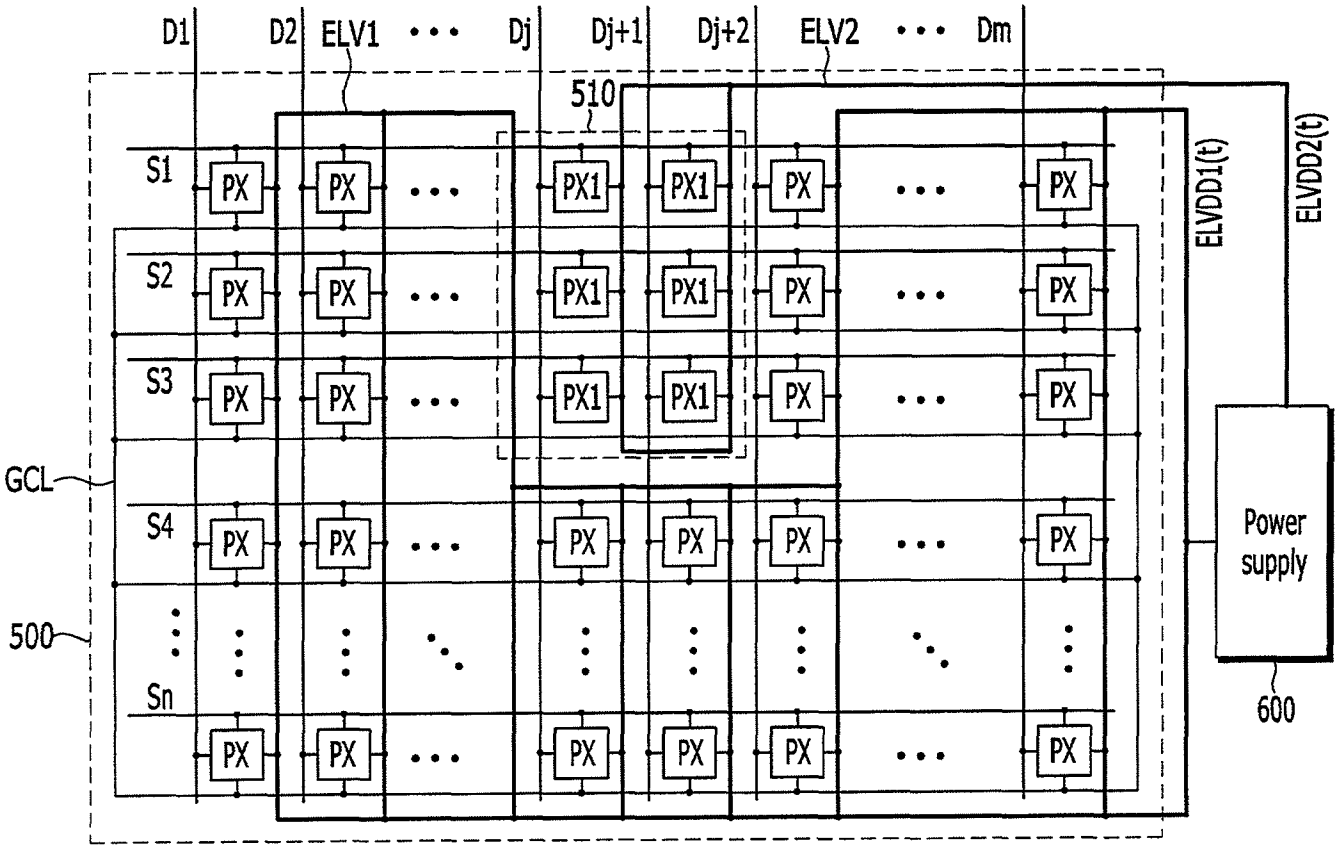
FIG. 6 illustrates a display unit of a display device according to another exemplary embodiment.

FIG. 6 illustrates a display unit of a display device according to another exemplary embodiment. Distinguished from the display device illustrated in FIG. 5, the display area 510 in which plural compensation pixels PX1 are arranged is separated from a power line connected to plural normal pixels PX.

The power supply 600, a component of the display device, generates the first power source voltage ELVDD(t) illustrated in FIG. 2 and supplies the first power source power ELVDD(t) to the display unit 500 under the control of the signal controller 100. The first power source voltage ELVDD(t) includes a normal power source voltage ELVDD1(*t*) and a compensation power source voltage ELVDD2(*t*). The compensation power source voltage ELVDD2(*t*) has a high level of VSUS−Vth, as described above.

The normal power source voltage ELVDD1(*t*) is supplied to the plurality of normal pixels PX through a power line ELV1 and the compensation power source voltage ELVDD2(*t*) is supplied to the plurality of compensation pixels PX1 through a power line ELV2. As shown in FIG. 6, the plurality of compensation pixels PX1 is connected to the power line ELV2 and the plurality of normal pixels PX is connected to the power line ELV1.

Here, the compensation power source voltage ELVDD2(*t*) can be determined in consideration of threshold voltages of driving transistors of the compensation pixels PX1 located in the display area 510. For example, the high level of the compensation power source voltage ELVDD2(*t*) can be determined by subtracting the threshold voltage of a specific compensation pixel, the average of the threshold voltages of the driving transistors of the compensation pixels PX1, a minimum value or a maximum value of the threshold voltages from the voltage VSUS.

By way of summation and review, when a compensation transistor malfunctions, e.g., is short-circuited, a high-level driving voltage that drives the pixel circuit is supplied to the driving transistor. Thus, a pixel having the defective compensation transistor is displayed as a dark spot.

In contrast, as described above, embodiments provide a display device and a driving method thereof that prevents a pixel having a defective compensation transistor from being displayed as a dark spot.

According to exemplary embodiments of the present invention, a display device and a driving method thereof to prevent a pixel having a defective compensation transistor from being displayed as a dark spot are provided by using at least one compensation pixel.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device, comprising:

a normal pixel including a first driving transistor and a first compensation transistor connected between the gate and drain of the first driving transistor; and a compensation pixel including a second driving transistor and a second compensation transistor connected between the gate and drain of the second driving transistor, wherein the second compensation transistor is open.

2. The display device of claim 1, wherein a compensation control signal is supplied to the gate of the first compensation transistor and the compensation control signal is not supplied to the gate of the second compensation transistor.

3. The display device of claim 1, wherein the normal pixel further includes a first capacitor connected to the gate of the first driving transistor and the compensation pixel further includes a second capacitor connected to the gate of the second driving transistor.

4. The display device of claim 3, wherein the second capacitor is short-circuited.

5. The display device of claim 4, wherein the normal pixel further includes a third capacitor connected between the gate and source of the first driving transistor and the compensation pixel further includes a fourth capacitor connected between the gate and source of the second driving transistor.

6. The display device of claim 1, wherein the compensation pixel further includes a second capacitor having one electrode connected to the gate of the second driving transistor and a fourth transistor connected to the other electrode of the second capacitor and the source of the second driving transistor.

7. The display device of claim 6, wherein the second capacitor is short-circuited.

8. The display device of claim 1, wherein a normal power source voltage supplied to the first driving transistor is different from a compensation power source voltage supplied to the source of the second driving transistor.

9. The display device of claim 8, wherein a high level of the compensation power source voltage is determined in consideration of the threshold voltage of the second driving transistor.

10. The display device of claim 9, wherein the high level of the compensation power source voltage corresponds to a voltage obtained by subtracting the threshold voltage of the second driving transistor from a high level of the normal power source voltage.

11. A display device, comprising:

a plurality of scan lines;

a plurality of data lines;

a compensation control line;

a plurality of normal pixels connected to corresponding scan lines from among the plurality of scan lines, corresponding data lines from among the plurality of data lines and the compensation control line; and at least one compensation pixel connected to a corresponding scan line from among the plurality of scan lines and a corresponding data line from among the plurality of data lines, but not to the compensation control line.

12. The display device of claim 11, further comprising:

a first power line supplying a normal power source voltage to the plurality of normal pixels; and a second power line supplying a compensation power source voltage to the at least one compensation pixel.

13. The display device of claim 12, wherein the first power line is connected to a source of a first driving transistor of each of the plurality of normal pixels and the second power line is connected to a source of a second driving transistor of the at least one compensation pixel.

14. The display device of claim 13, wherein, when the display device includes two or more compensation pixels, a high level of the compensation power source voltage is determined based on the threshold voltages of the second driving transistors of the compensation pixels.

15. The display device of claim 14, wherein the high level of the compensation power source voltage corresponds to a voltage obtained by subtracting a voltage determined based on the threshold voltages of the second driving transistors from a high level of the normal power source voltage.

16. The display device of claim 11, wherein the normal pixel includes a first driving transistor and a first compensation transistor having a gate connected between the gate and drain of the first driving transistor and connected to the compensation control line, and the at least one compensation pixel includes a second driving transistor and a second compensation transistor between the gate and drain of the second driving transistor, the second compensation transistor being open.

17. The display device of claim 16, wherein the at least one compensation pixel includes a second capacitor having a first electrode connected to the gate of the second driving transistor, a switching transistor between a second electrode of the second capacitor and a corresponding data line, and having a gate connected to a corresponding scan line, and a third capacitor between the gate and source of the second driving transistor.

18. The display device of claim 17, wherein the second capacitor is short-circuited.

19. The display device of claim 17, wherein a compensation power source voltage supplied to the source of the second driving transistor is different from a normal power source voltage supplied to the source of the first driving transistor.

20. A method of driving a display device including a plurality of normal pixels and at least one compensation pixel, the method comprising:

turning on a first compensation transistor connected to a gate and a drain of a first driving transistor of each of the plurality of normal pixels during a predetermined period;

transmitting data voltages respectively corresponding to the plurality of normal pixels and the at least one compensation pixel; and emitting light from the plurality of normal pixels and the at least one compensation pixel according to the data voltages corresponding thereto, wherein a second compensation transistor connected to a gate and a drain of a second driving transistor of the at least one compensation pixel is open.

21. The method of claim 20, wherein transmitting the data voltages comprises:

transmitting a corresponding data voltage through a first capacitor connected to the gate of the first driving transistor of each of the plurality of normal pixels; and transmitting a corresponding data voltage to the gate of the second driving transistor of the at least one compensation pixel.

22. The method of claim 20, wherein emitting light according to the data voltages comprises:

supplying a normal power source voltage at a first high level to a source of the first driving transistor; and supplying a compensation power source voltage at a second high level to a source of the second driving transistor, wherein the first high level is different from the second high level.

23. The method of claim 22, wherein a difference between the first high level and the second high level is determined based on the threshold voltage of the second driving transistor.

* * * * *